US008070513B2

(12) United States Patent
Ko et al.

(10) Patent No.: US 8,070,513 B2
(45) Date of Patent: Dec. 6, 2011

(54) CABLE ASSEMBLY WITH IMPROVED WIRE HOLDING DEVICE

(75) Inventors: David Ko, Fullerton, CA (US); Jim Zhao, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/727,419

(22) Filed: Mar. 19, 2010

(65) Prior Publication Data

US 2011/0230088 A1 Sep. 22, 2011

(51) Int. Cl.
*H01R 9/05* (2006.01)

(52) U.S. Cl. ..... 439/579; 439/604; 29/882

(58) Field of Classification Search ..... 439/604, 439/736, 497, 579; 29/858, 883, 882
See application file for complete search history.

(56) References Cited

U.S. PATENT DOCUMENTS 4,097,106 A * 6/1978 Over et al. ..... 439/398
6,705,893 B1 3/2004 Ko
7,018,231 B2 * 3/2006 Liu et al. ..... 439/492

* cited by examiner

*Primary Examiner* — Ross Gushi
(74) *Attorney, Agent, or Firm* — Wei Te Chung; Andrew C. Cheng; Ming Chieh Chang

(57) ABSTRACT

A cable assembly includes a housing including a main body and a piece of mushy insulation block on the housing, a plurality of contacts receiving in the main body of the housing, and a plurality of cable. Each of the cable includes at least an inner conductor and an outer insulation layer. The inner conductors are soldered to the contacts and the outer insulation layer each has a part fixed in the mushy insulation block of the housing.

18 Claims, 10 Drawing Sheets

CABLE ASSEMBLY WITH IMPROVED WIRE HOLDING DEVICE

BACKGROUND OF THE INVENTION

1. Field of the Invention

The present invention relates generally to a cable assembly, and more particularly to a cable assembly used in electric device and having improved wire holding device.

2. Description of the Prior Art

Present cable assembly always includes a housing, a plurality of contacts and a plurality of cables. There are a few of types of contacts used in present cable assembly, such as soldering contact, insulation displacement contact (IDC), and crimping contact and so on. When the contact is connected to the cable through soldering method, the cable assembly sometimes defines a spacer with a plurality of slots to receive different cables. U.S. Pat. No. 6,705,893, issued to Hon Hai on Mar. 16, 2004, discloses a cable assembly with spacer, contacts and cables. The cables are received in spacer and soldered to the contacts. However, if the cables are soldered to the contacts by machines, some inner conductors of the cables can not fully connect to the contacts leading to badness connecting between the cables and contacts.

Hence, in this art, a better method for using machine to solder the contacts and cables to overcome the above-mentioned disadvantages of the prior art should be provided.

BRIEF SUMMARY OF THE INVENTION

A primary object, therefore, of the present invention is to provide a cable assembly with an improved wire holding device and a method for producing the cable assembly.

In order to implement the above object, the cable assembly comprises a housing comprising a main body and a piece of mushy insulation block on the housing, a plurality of contacts receiving in the main body of the housing, and a plurality of cable. Each of the cable comprises at least an inner conductor and an outer insulation layer. The inner conductors are soldered to the contacts and the outer insulation layer each has a part fixed in the mushy insulation block of the housing.

Other objects, advantages and novel features of the invention will become more apparent from the following detailed description of a preferred embodiment when taken in conjunction with the accompanying drawings.

DETAILED DESCRIPTION OF THE INVENTION

Figure 1:
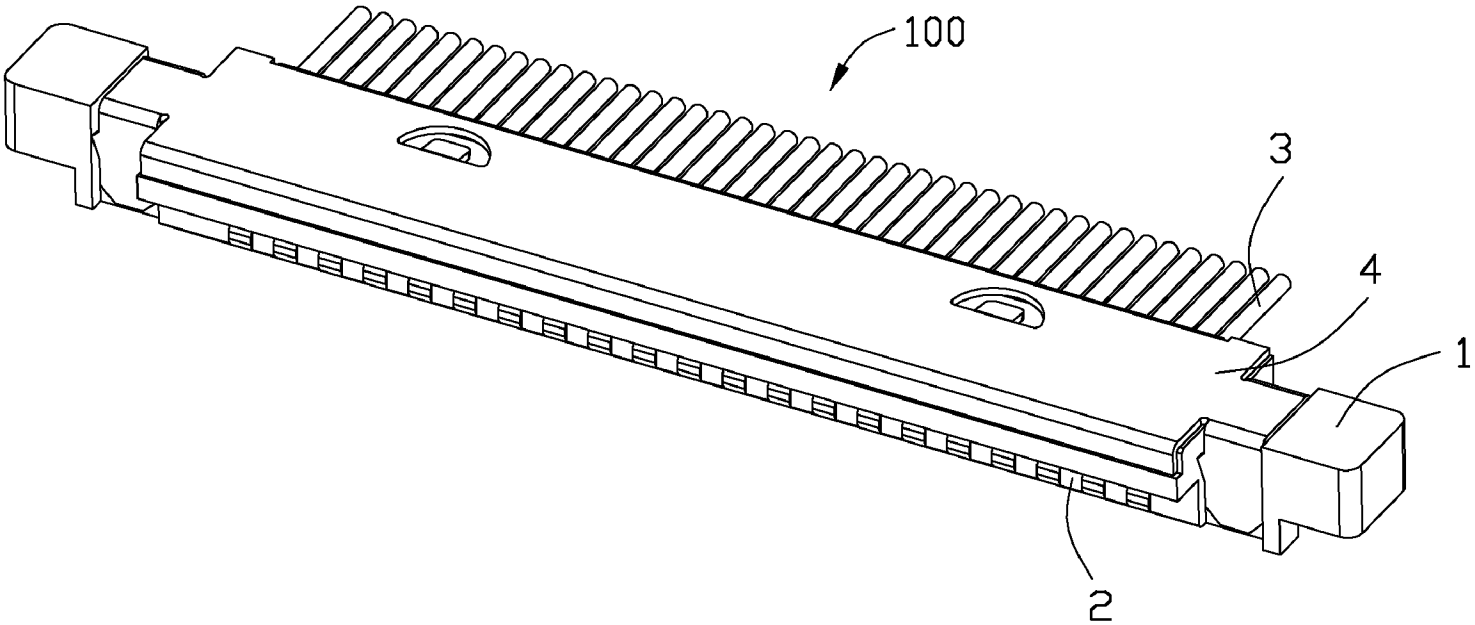
FIG. 1 is a perspective view of a cable assembly in according with the present invention.
Figure 2:
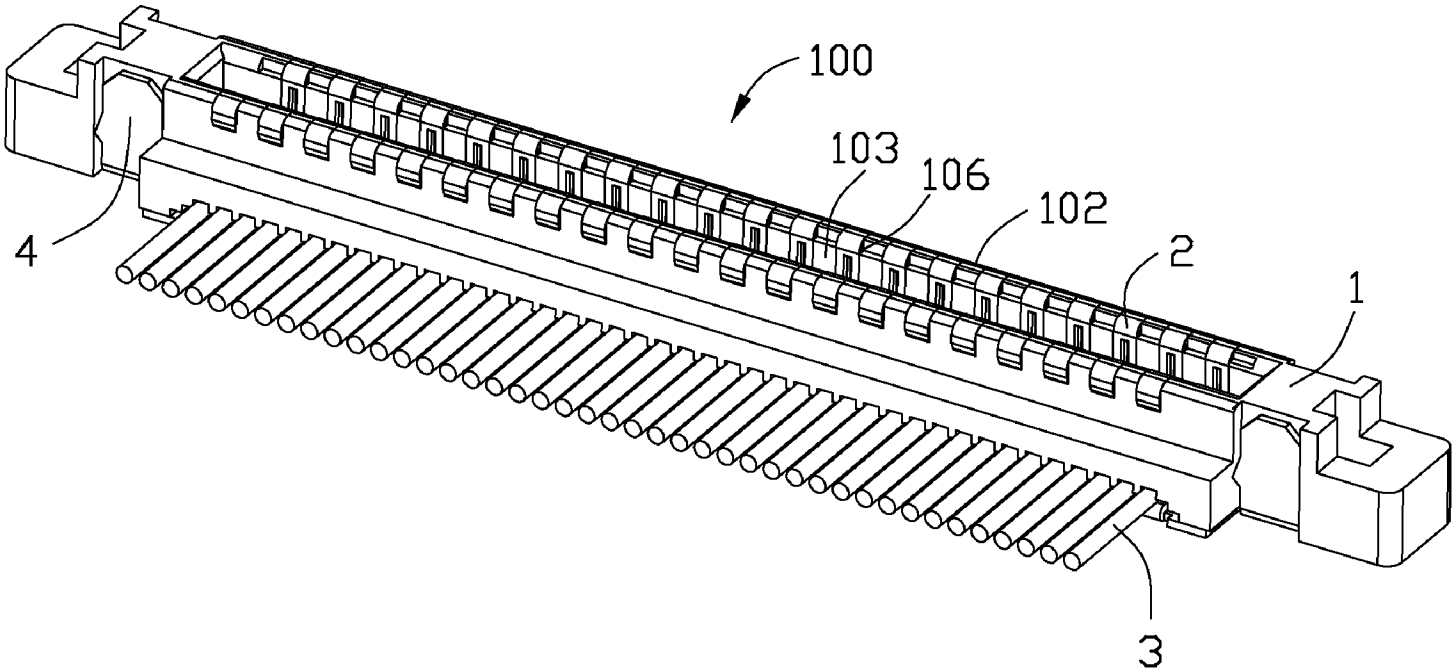
FIG. 2 is a view similar to FIG. 1, but taken from a different aspect.
Figure 3:
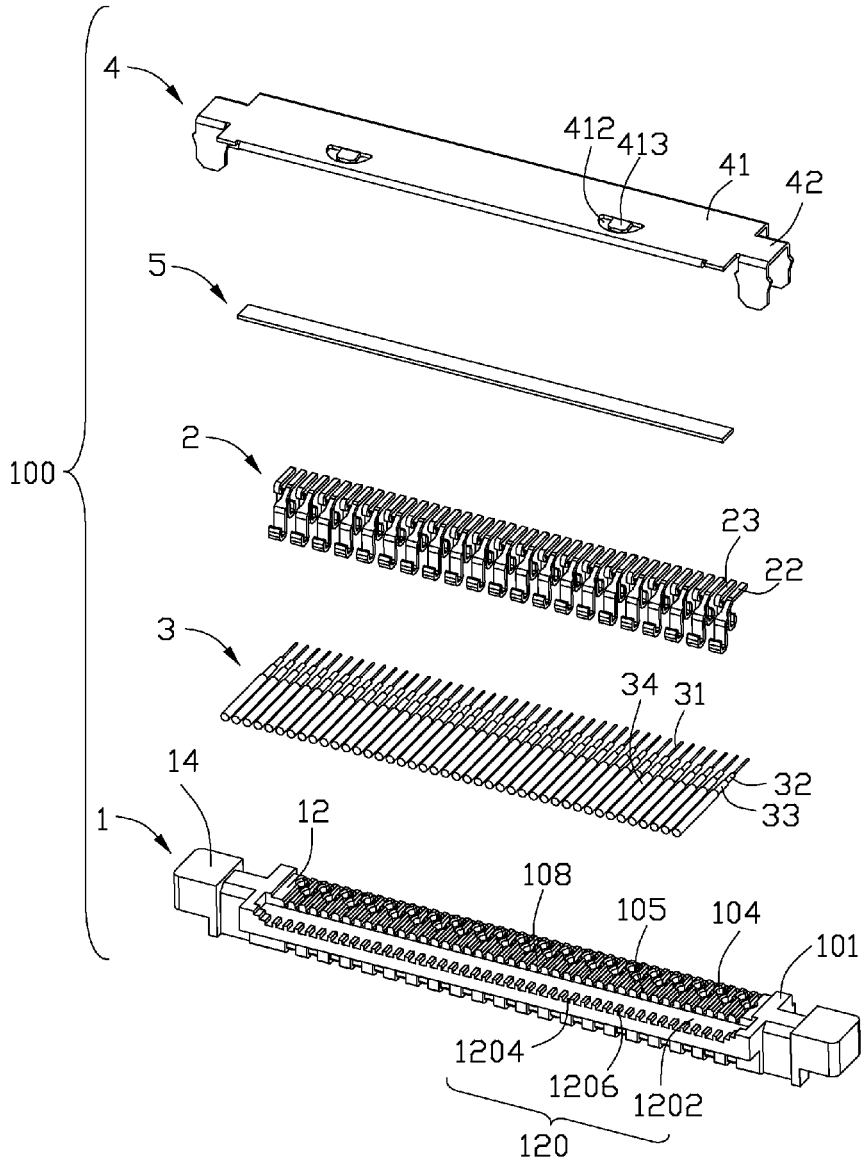
FIG. 3 is an exploded, perspective view of the cable assembly in according with the present invention.
Figure 4:
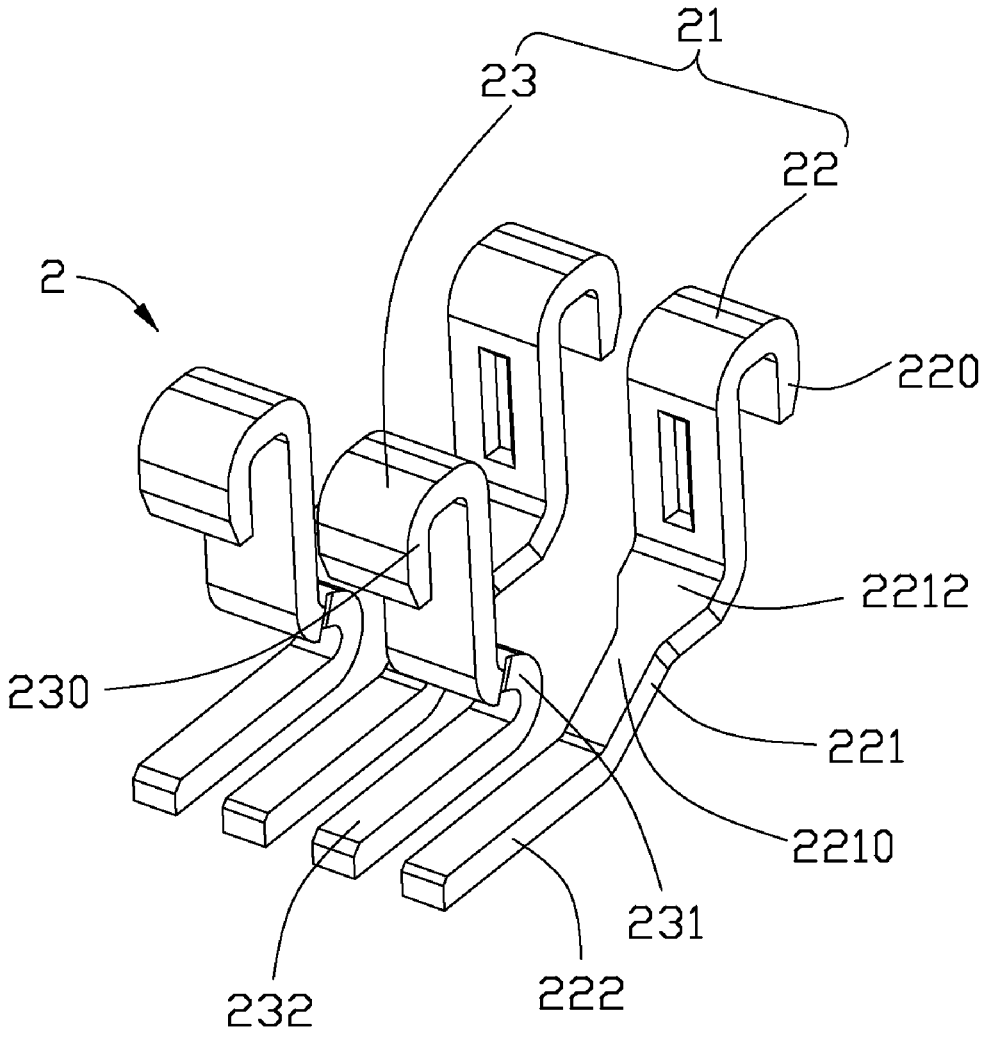
FIG. 4 is a perspective view of a few of contacts of the cable assembly in according with the present invention.

Reference will now be made in detail to a preferred embodiment of the present invention.

FIGS. 1 to 4 illustrate perspective views of a cable assembly 100 made in accordance with the present invention and used to exchange electrical signals and be connected to the complementary connector (not shown). The cable connector 1 comprises a housing 1 having receiving space 103 therein and comprising an upper surface 101 and a lower surface 102, a plurality of contact group 2 assembled on the housing and received in the receiving space, a plurality of cables 3 and a metal shell 4 covering the upper surface 101 of the housing 1.

The housing 1 comprises a main body 12 with the upper surface 101 and the lower surface 102 and a pair of side arms 14 extending from two sides of the main body 12. The receiving space 103 is formed in the main body by upward extending from the lower surface 102 and comprises a plurality of receiving through 106 respectively arranged on the two side inner walls of the receiving space and extending to the outer walls. A plurality of receiving slots 104 are formed by downward extending from the upper surface 101 to communicate to the receiving space 103. A plurality of passageways 105, respectively corresponding to the receiving slots 104, are defined on the main body 12 by extending along a front-to-back direction perpendicular to the receiving slots 104 on the upper surface 101. The passageways 105 are formed by a plurality of ribs 108 on the upper surface 101 of the main body 12. The housing 1 further comprises a spacer 120 extending from the main body 12. The spacers 120 comprises a flat floor 1202 is nestled on the main body 12 and a plurality of receiving grooves 1204 formed by a plurality of ribs 1206 upward extending from the flat floor 1202. One end portions of the cables 3 are received in the receiving grooves 1204 respectively.

The contact group 2 comprises a plurality of pairs of contacts 21. Each pair of contacts 21 includes a first conduct 22 and a second conduct 23. The first contact 22 comprises a J-shaped section 220, a soldering section 222, and a connecting section 221 connecting the J-shaped section 220 to the soldering section 222. The second contact 23 comprises a J-shaped section 230 mirror symmetrical with the J-shaped section 220 of the first contact, a soldering section 232 and a connecting section 221 connecting the J-shaped section 230 to the soldering section 232. The soldering sections 222, 232 are narrower than the J-shaped sections 220, 230, and the connecting sections 221, 231 has a narrower end 2210 connected to the soldering sections 222, 232 and a wider end 2212 connected to the J-shaped sections 220, 230. The connecting section 221 of the first contact 22 extends along a straight line and the connecting section 231 of the second contact 23 is bend to approximately form a U-shaped configuration. The J-shaped sections 220, 230 are respectively received in the receiving through 106 of the main body 12, and the soldering sections 222, 232 are respectively receiving in the passageways 105 of the main body 12. The connecting sections 221, 231 respectively pass through the receiving slots 104 of the main body 12.

The shell 4 comprises a flat main body 41, and a pair of side arms 42 extending from the two sides of the main body 41. The main body 41 comprises two holes 412 therethrough and two flexible pieces 413 respectively received in the two holes 412.

Each of the cable 3 comprises an inner conductor 31, an inner insulation layer 32, an outer conductor 33, an outer insulation layer 34. The inner insulation layers 32 are received in the passageway 105 and the ribs 108 are higher than the inner insulation layers 32. A part of the outer insulation layers 34, which are adjacent to the outer conductor 33, are received in the receiving grooves 1204 and the ribs 1026 are lower than the outer insulation layers 34. The cable assembly 100 further comprises a grounding bar 5 fixed on the outer conductor 33 and electrically connected to all of the outer conductors 33.

Figure 5:
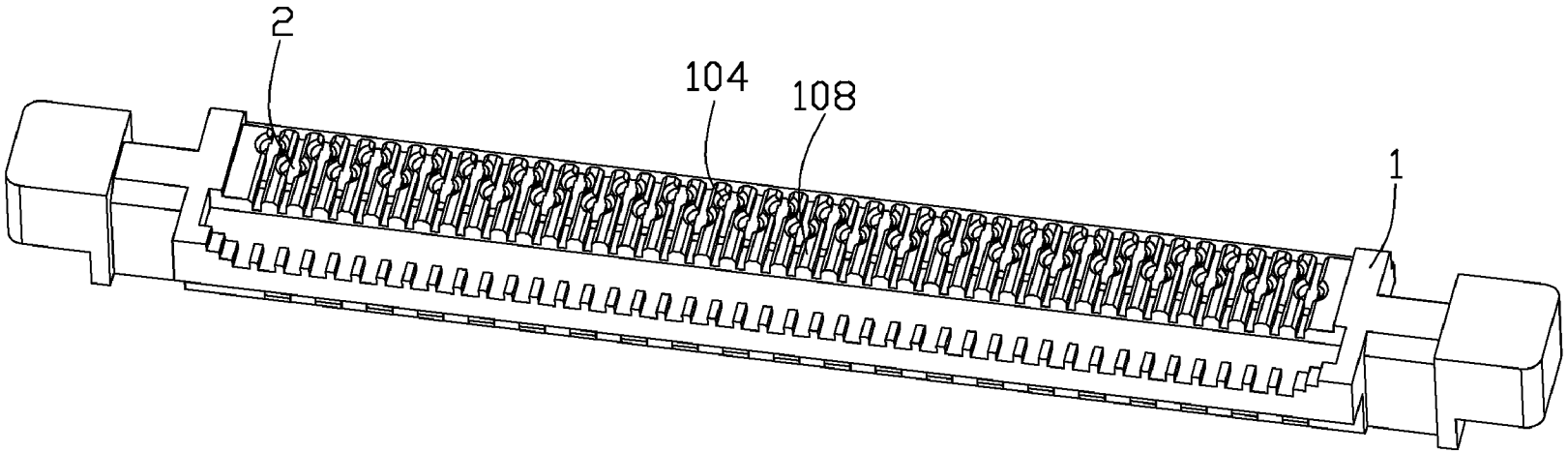
FIG. 5 is an assembled perspective view of a housing assembled with contacts therein of the present invention.
Figure 6:
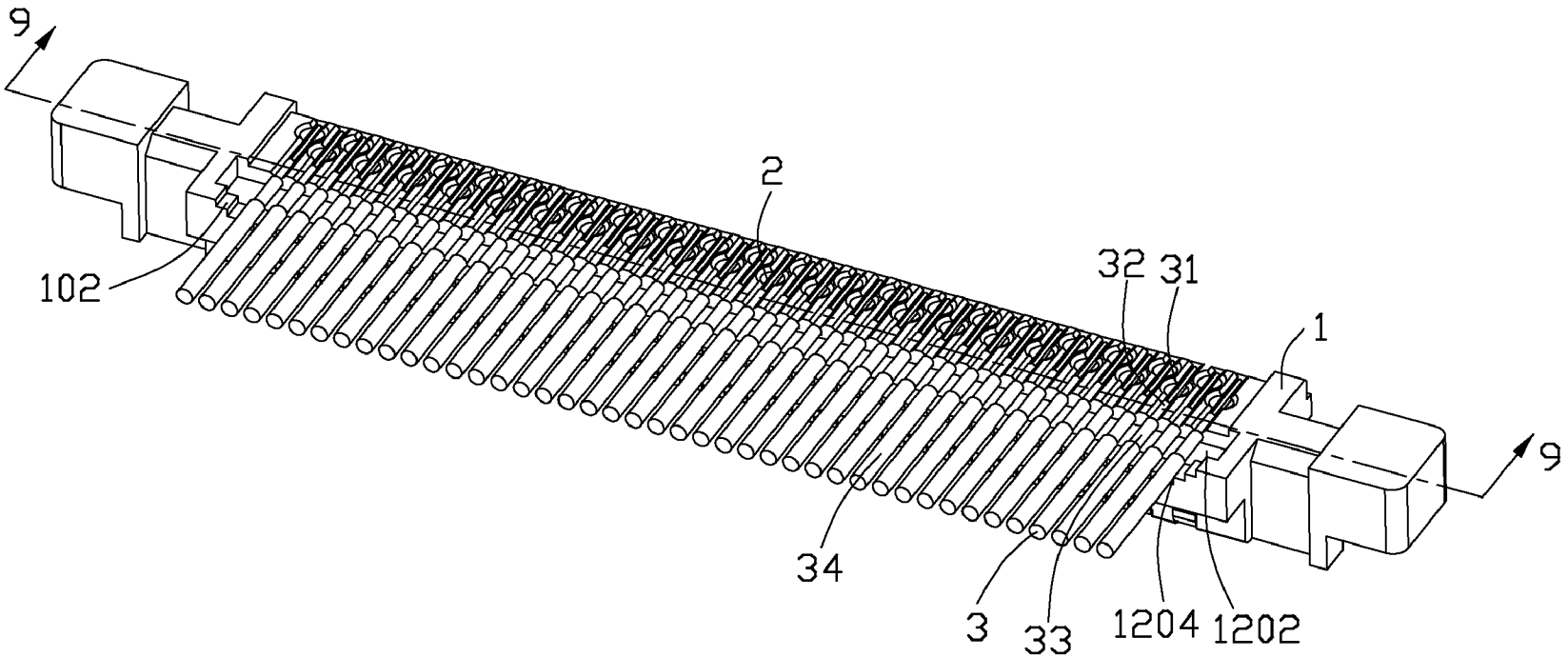
FIG. 6 is an assembled perspective view of a housing with contacts and cables of the present invention.
Figure 7:
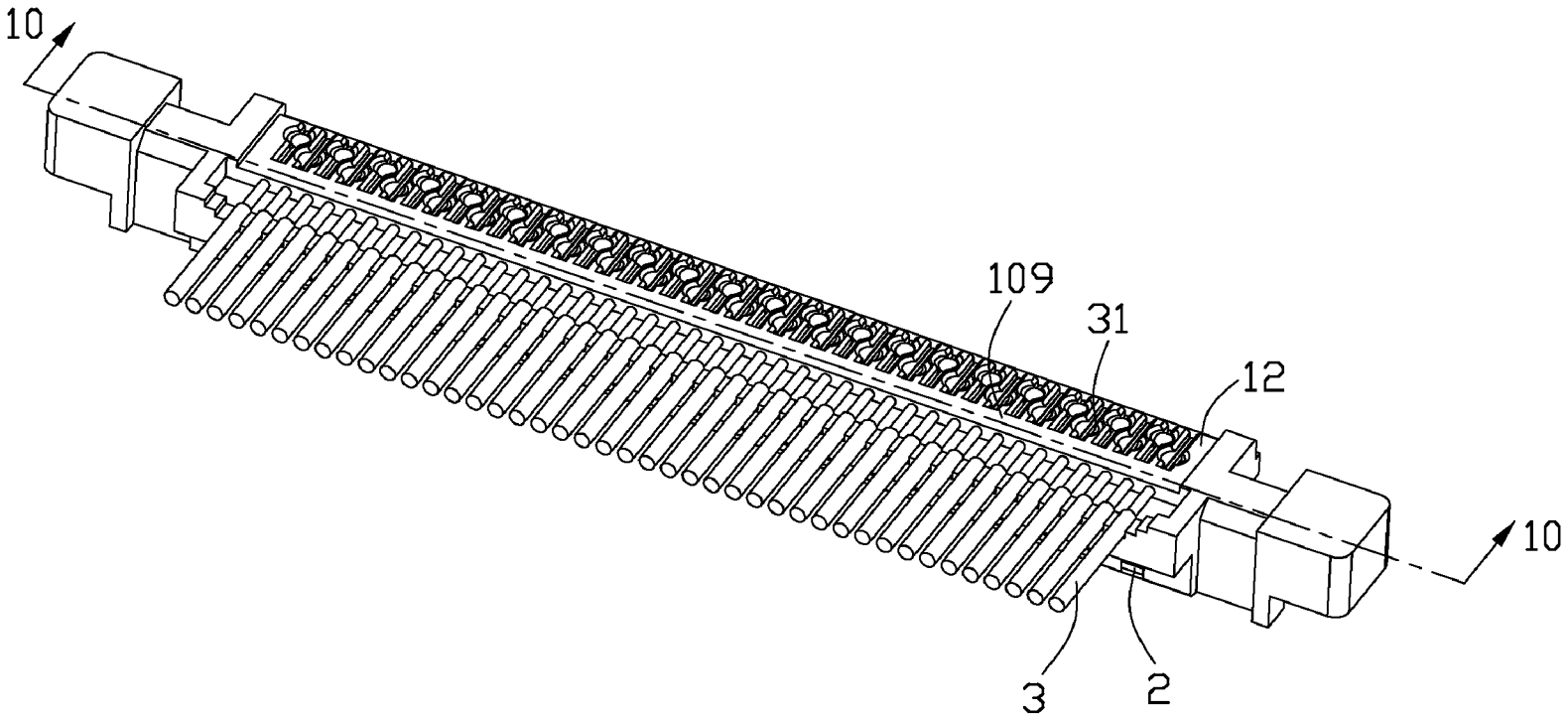
FIG. 7 is an assembled perspective view of a housing with contacts, cables and hot-melt ribs of the present invention.
Figure 8:
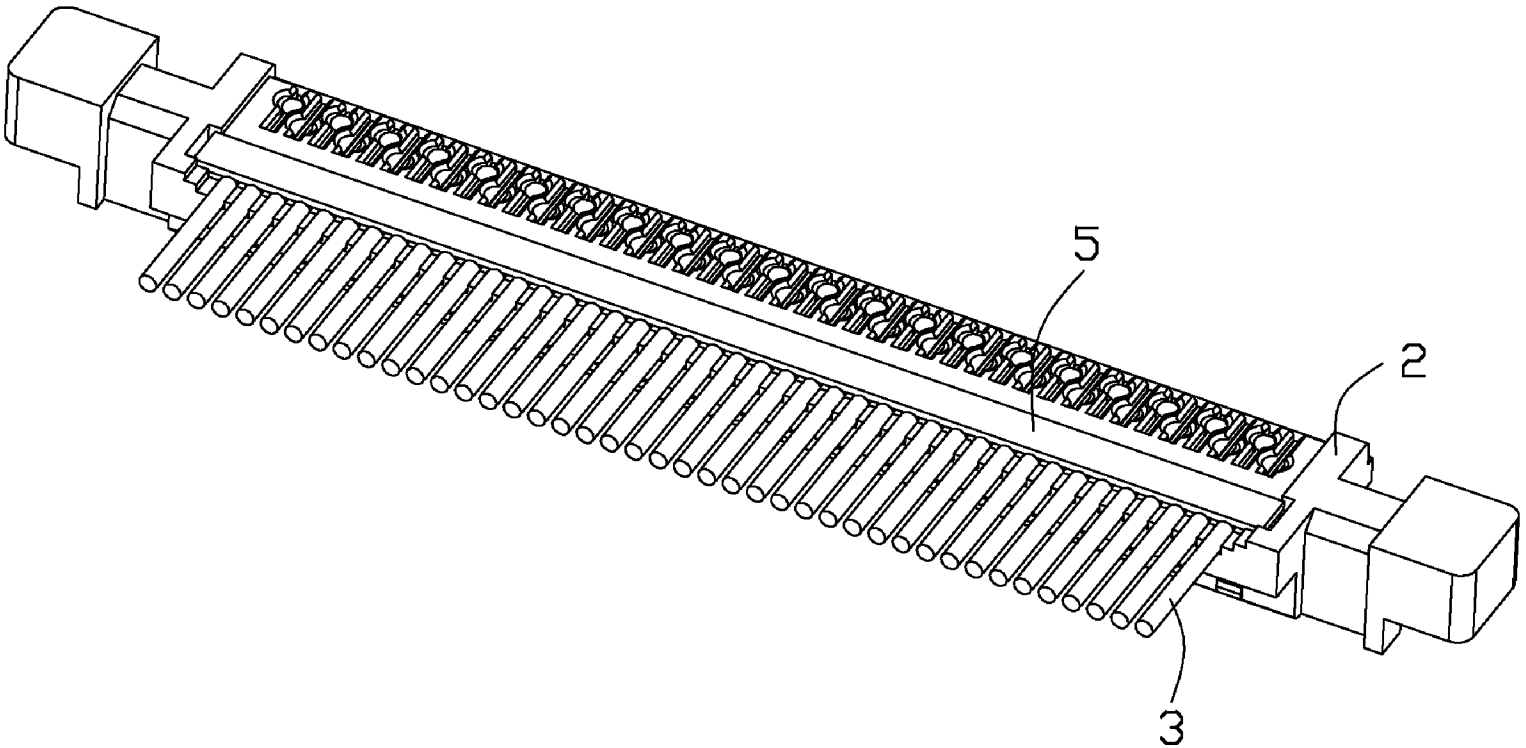
FIG. 8 is an assembled perspective view of a housing, contacts, cables, hot-melt ribs and a grounding bar of the present invention.
Figure 9:
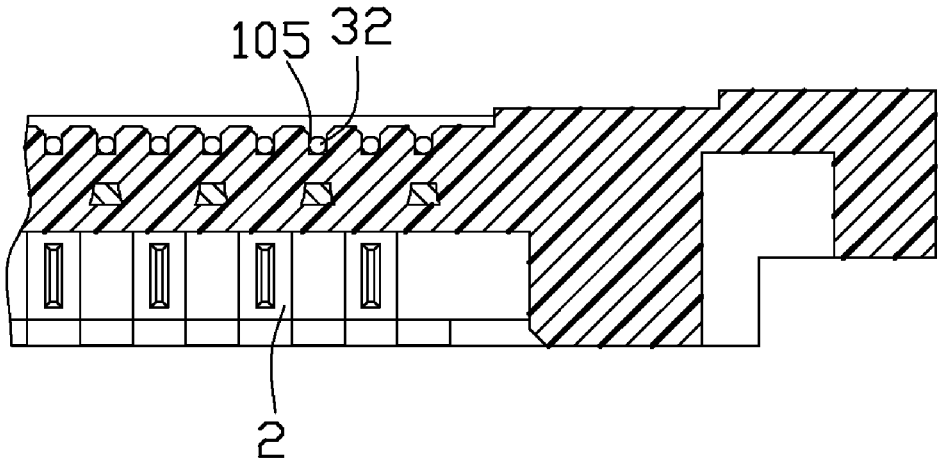
FIG. 9 is a cross-section view of the cable assembly taken along line 9-9 of FIG. 6.
Figure 10:
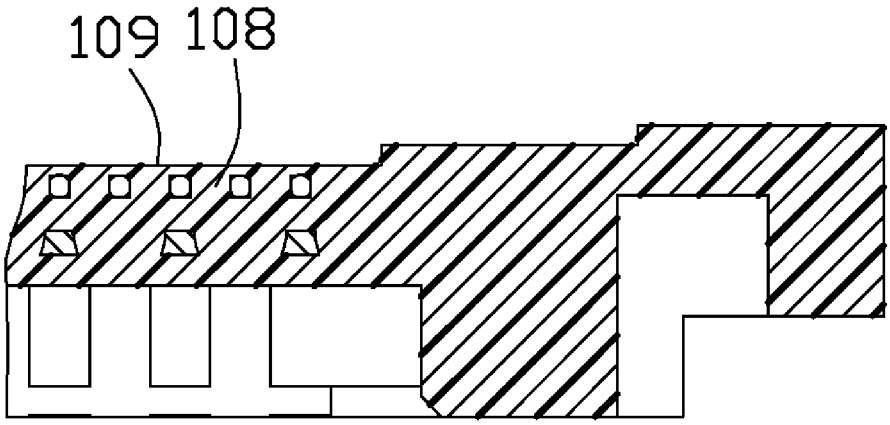
FIG. 10 is a cross-section view of the cable assembly taken along line 10-10 of FIG. 7.

In assembly, firstly, referencing to FIG. 5, the contacts 2 are fixed on the housing 1 to be received in the receiving slots 104. Secondly, referencing to FIG. 6 and FIG. 9, the cable 3 are set on the spacer 120 of the housing 1 with the inner conductor 31 touching the contacts 2, the outer conductor 33 received in the flat floor 1202 of the spacer 120, the inner insulation layer 32 set in the passageways 105, and the outer insulation layer 34 set in the receiving grooves 1204 of the spacer 120. Thirdly, referencing to FIG. 7 and FIG. 10, the ribs 108 are melt by hot bar method to make the ribs 108 flow into the passageways 105 to form a piece of mushy insulation block 109 to fix the inner insulation layers 32 of the cables 3 on the main body 12. Thus, the fixing of the insulation layers 32 can sustain a good electrical connecting between the soldering sections 222 of the contacts 2 and the inner conductors 31. Fourthly, the inner conductors 31 are soldered on the soldering sections of the contacts 2 to make the inner conductors 31 securely fixed on the contacts 2. Fifthly, referencing to FIG. 3 and FIG. 7, the grounding bar 5 is soldered on the outer conductors 33 of the cables 3 and electrically connected to each of the outer conductor 33 of the cables 3. Lastly, fix the shell 4 onto the housing 1. The structure and manufacturing method of the cable assembly 100 are suit for machine to solder the cables 3 to the contacts 2. In other embodiments, the cable assembly can be design to any structure except for owning a plurality of ribs to form a plurality of receiving grooves to receive cables, the cables can not be coaxial cables yet, and the ribs 106 can be hot melt by other method.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a housing comprising a main body and a piece of mushy insulation block on the housing;

a plurality of contacts receiving in the main body of the housing;

a plurality of cables each being a coaxial cable and comprising at least an inner conductor, an inner insulation layer, an outer insulation layer, and an outer conductor, said inner conductors being soldered to the contacts and said outer insulation layers each having a part fixed in the mushy insulation block of the housing.

2. The cable assembly as claimed in claim 1, wherein the housing further comprises a spacer, said spacer comprises a flat floor and the insulation block is formed on the flat floor, said outer conductor is received in the flat floor.

3. The cable assembly as claimed in claim 1, wherein the main body of the housing comprises a receiving space therein, an upper surface and a lower surface, said receiving space has a plurality of receiving slots downward extending from the upper surface to communicate to the receiving space.

4. The cable assembly as claimed in claim 3, wherein the housing further comprises a plurality of passageways respectively corresponding to the receiving slots and formed by extending along a front-to-back direction perpendicular to the receiving slots.

5. The cable assembly as claimed in claim 4, wherein the contacts comprises a plurality of pairs of contacts which each comprises a first contact and a second contact.

6. The cable assembly as claimed in claim 5, wherein the first and second contacts respectively comprises a J-shaped section, a soldering section narrower than the J-shaped section, and a connecting section connecting the J-shaped section to the soldering section.

7. The cable assembly as claimed in claim 6, wherein the J-shaped section of the first contact is mirror symmetrical with the J-shaped section of the second contact, the connecting sections of the two contacts respectively comprising a narrower end connected to the soldering section and a wider end connected to the J-shaped section.

8. The cable assembly as claimed in claim 7, wherein the connecting section of the first contact extends along a straight line and the connecting section of the second contact is bend to approximately form a U-shaped configuration.

9. The cable assembly as claimed in claim 6, wherein the J-shaped sections of the pair of contacts are respectively received in the receiving through of the main body, the soldering sections are respectively receiving in the passageways of the main body, the connecting sections respectively passes through the receiving slots of the main body, and the inner conductors of the cables are connected to the soldering sections of the conductors.

10. A method of making a cable assembly, comprising:

firstly, providing a housing with receiving space and a plurality of receiving grooves formed by a plurality of ribs;

secondly, providing a plurality of contacts and make them received in the receiving space;

thirdly, providing a plurality of cables which each has at least an inner conductor touched the contacts and an outer insulation layer with a part received in the receiving grooves;

fourthly, melting the ribs to flow into the receiving grooves and when the liquid ribs changed to solid again, the part of the outer insulation layer should be fixed in the receiving grooves;

fifthly, soldering the inner conductors of the cables onto the contacts by soldering device.

11. The method as claimed in claim 10, wherein the cable further comprises an inner insulation layer and an outer conductor covered the outer insulation layer.

12. The method as claimed in claim 11, further comprising one step between the fourth step and the fifth step to provide a grounding bar fixed on the outer conductors of the cables to electrically connecting to all outer conductors.

13. The method as claimed in claim 12, further comprising one step after the fifth step to provide a shell assembled onto the housing.

14. The method as claimed in claim 10, wherein the housing comprises a spacer, the receiving grooves and ribs are arranged on the spacer.

15. An electrical cable connector comprising:

an insulative housing defining a main body with a mating port thereof, and a mushy insulation block positioned upon the housing;

a plurality of contacts disposed in the housing with contacting sections exposed in the mating port and with tail sections exposed in the insulation block; and a plurality of cables each including an conductor and an insulator enclosing said conductor; wherein the conductor is soldered to the corresponding tail section, while the insulator is essentially circumferentially enclosed by the insulation block except along an axial direction under condition that said insulation block is originally formed with a plurality of grooves each separated by corresponding ribs and communicating with an exterior in both the axial direction and a radial direction while being deformed to be sealed in said radial direction after the corresponding cable is inserted thereinto wherein the cable and the corresponding ribs are attached to each other, wherein attachment between the ribs and the corresponding cable is made via fusion thermally.

16. The electrical cable connector as claimed in claim 15, wherein the insulation block and the housing is of one piece unitarily.

17. The electrical cable connector as claimed in claim 15, wherein the contacting sections of the contacts are arranged in one row while the tail sections of the contacts are arranged in two rows.

18. The electrical cable connector as claimed in claim 17, wherein the tail sections are located on one longitudinal side of the housing while the cables extend away from the housing on the other longitudinal side.

* * * * *